US010244611B2

(12) United States Patent
Yang

(10) Patent No.: US 10,244,611 B2
(45) Date of Patent: Mar. 26, 2019

(54) MULTI-COLOR LIGHT APPARATUS

(71) Applicant: Jetmax Lighting Industrial Co., Limited, Dongguan (CN)

(72) Inventor: Ping Yang, Dongguan (CN)

(73) Assignee: Jetmax Lighting Industrial Co., Limited (CN)

( * ) Notice: Subject to any disclaimer, the term of this patent is extended or adjusted under 35 U.S.C. 154(b) by 0 days.

(21) Appl. No.: 15/467,354

(22) Filed: Mar. 23, 2017

(65) Prior Publication Data

US 2018/0279438 A1 Sep. 27, 2018

(51) Int. Cl.
*H05B 37/02* (2006.01)
*H05B 33/08* (2006.01)

(52) U.S. Cl.
CPC ..... *H05B 37/029* (2013.01); *H05B 33/086* (2013.01)

(58) Field of Classification Search
CPC ..... H05B 33/0842; H05B 33/083; H05B 37/0281; H05B 37/02; H05B 37/029; F21S 4/10; G01R 19/16585; G01R 29/02
USPC ..... 315/294, 297, 308, 323, 360, 185 S, 315/200 R; 345/691, 99
See application file for complete search history.

(56) References Cited

U.S. PATENT DOCUMENTS

2005/0162851 A1* 7/2005 Kazar ..... H05B 37/029 362/231
2009/0167483 A1* 7/2009 Jones ..... H05B 37/029 340/3.7
2012/0086349 A1* 4/2012 Segan ..... H05B 33/0803 315/187
2014/0191746 A1* 7/2014 Davie ..... H05B 33/08 324/66

FOREIGN PATENT DOCUMENTS

CN 106332377 A * 1/2017

* cited by examiner

*Primary Examiner* — Tung X Le
*Assistant Examiner* — Henry Luong
(74) *Attorney, Agent, or Firm* — Lerner, David, Littenberg, Krumholz & Mentlik, LLP

(57) ABSTRACT

A multi-color light apparatus is provided and includes a power adapter, a power switch and a plurality of light bulbs. The power adapter has a converter to convert AC power to DC power. The power switch is electrically connected to the power adapter and includes a controller to provide a plurality of time division multiplexed signals. The light bulbs receive the time division multiplexed signals and are configured to perform different illumination effects in accordance with the time division multiplexed signals. By using the multi-color light apparatus, only two power wires are used so as to simplify the manufacture of the multi-color light apparatus and reduce the cost of the manufacture.

4 Claims, 3 Drawing Sheets

MULTI-COLOR LIGHT APPARATUS

BACKGROUND OF THE INVENTION

1. Field of the Invention

The present invention relates to a multi-color light apparatus, and more particularly to a multi-color light apparatus with only two power wires to transmit data and power.

2. Description of Related Art

In winter, most people living in North America will decorate their houses with multi-color light apparatus to celebrate Christmas. The multi-color light apparatus includes many different illumination functions, such as showing different colors (red, green or blue color), flashing and so on.

Normally, the multi-color light apparatus with many different illumination functions is driven by a driving control integrated circuit (IC). The driving control IC will output different control signals to the multi-color light apparatus, so a plurality of light bulbs in the multi-color light apparatus will be randomly or sequentially turned on according to the control signals.

With reference to FIG. 3, a conventional driving control IC 30 includes a plurality of pins. Those pins include a red light output pin (OUTR), a green light output pin (OUTG), a blue light output pin (OUTB), a ground pin (GND), a signal output pin (SDO), a signal input pin (SDI), a mode set pin (SET) and a power input pin (VDD). The data signal is outputted from the driving control IC 30 via an electric wire. The power signal is outputted from the driving control IC 30 via another electric wire. Therefore, the conventional driving control IC 30 requires at least three electric wires (a data wire, a positive power wire and a negative power wire) to drive the multi-color light apparatus to perform many different illumination effects.

Accordingly, a need arises to develop a multi-color light apparatus without using too many wires, so the cost is reduced and the usage of the electric wires is minimized.

SUMMARY OF THE INVENTION

An objective of the present invention is to develop a multi-color light apparatus to minimize a usage of electric wires so as to reduce the cost of the manufacture of the multi-color light apparatus.

In order to achieve the aforementioned purpose in the present invention, the present invention provides a multi-color light apparatus that includes a power adapter, a power switch and a plurality of light bulbs. The power adapter has a converter to convert AC power to DC power. The power switch is electrically connected to the power adapter and includes a controller to provide a plurality of time division multiplexed signals. The light bulbs receive the time division multiplexed signals and are configured to perform different illumination effects in accordance with the time division multiplexed signals.

The advantage in the present invention is to use a DCTD IC to control the light bulbs to include many different illumination effects. The data and power can be transmitted at the same time and only two power wires are used in the multi-color light apparatus. Accordingly, the cost to manufacture the multi-color light apparatus is reduced and the manufacturing process is simplified.

DETAILED DESCRIPTION OF THE PREFERRED EMBODIMENT

These and other aspects of the embodiments herein will be better appreciated and understood when considered in conjunction with the following description and the accompanying drawings.

Figure 1:
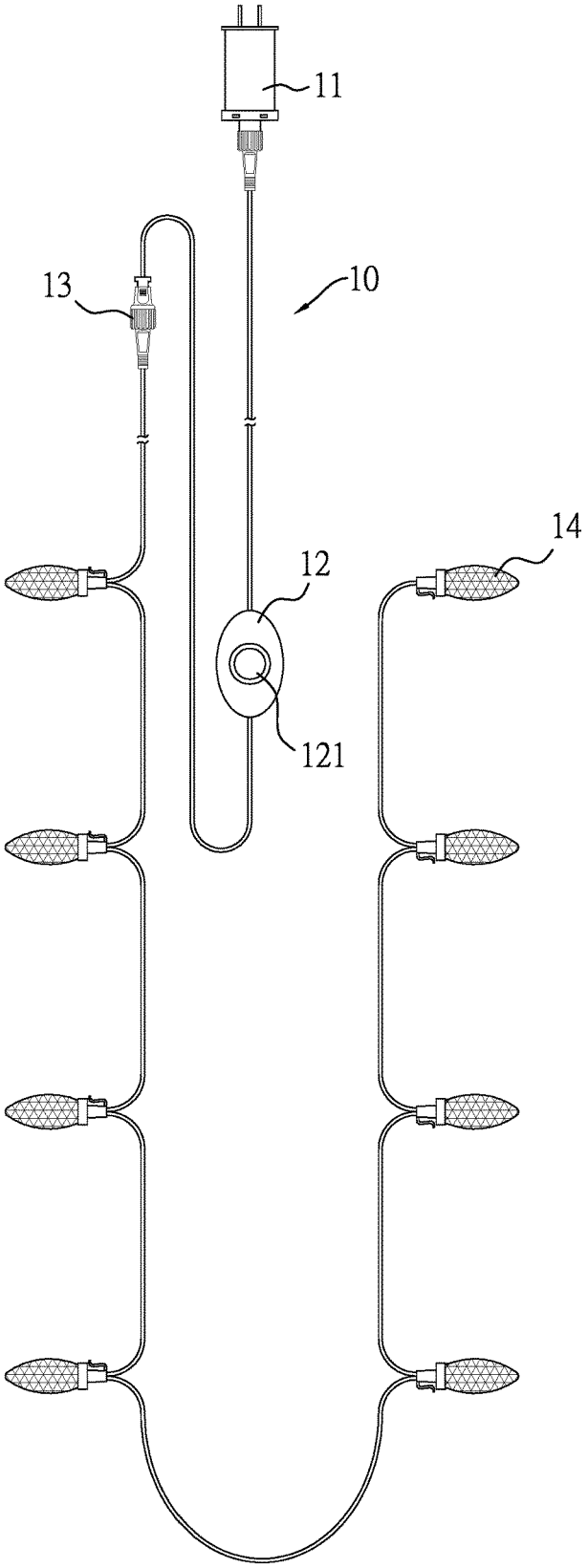
FIG. 1 is a plan view of a multi-color light apparatus in the present invention.

With reference to FIG. 1, a multi-color light apparatus 10 in the present invention includes a power adapter 11, a power switch 12, a connector 13 and a plurality of light bulbs 14.

The power adapter 11 is electrically connected to the power switch 12. The power switch 12 is electrically connected to the connector 13. The connector 13 is electrically connected between the power switch 12 and the light bulbs 14. The power switch 12 is not only used to turn on or off the light bulbs, but also used to switch different illumination functions of the light bulbs 14. By controlling the power switch 12, the light bulbs 14 will show many different illumination effects, such as flashing, sequentially or randomly turning on lights of different colors, and so on.

For example, in the embodiment of the present invention, the power switch 12 may be a power switch with one button 121. When a user presses the button 121 of the power switch 12, the power for the multi-color light apparatus 10 is turned on. When the user presses the button 121 of the power switch 12 again, the light bulbs 14 of the multi-color light apparatus 10 start randomly or sequentially flashing.

Figure 2:
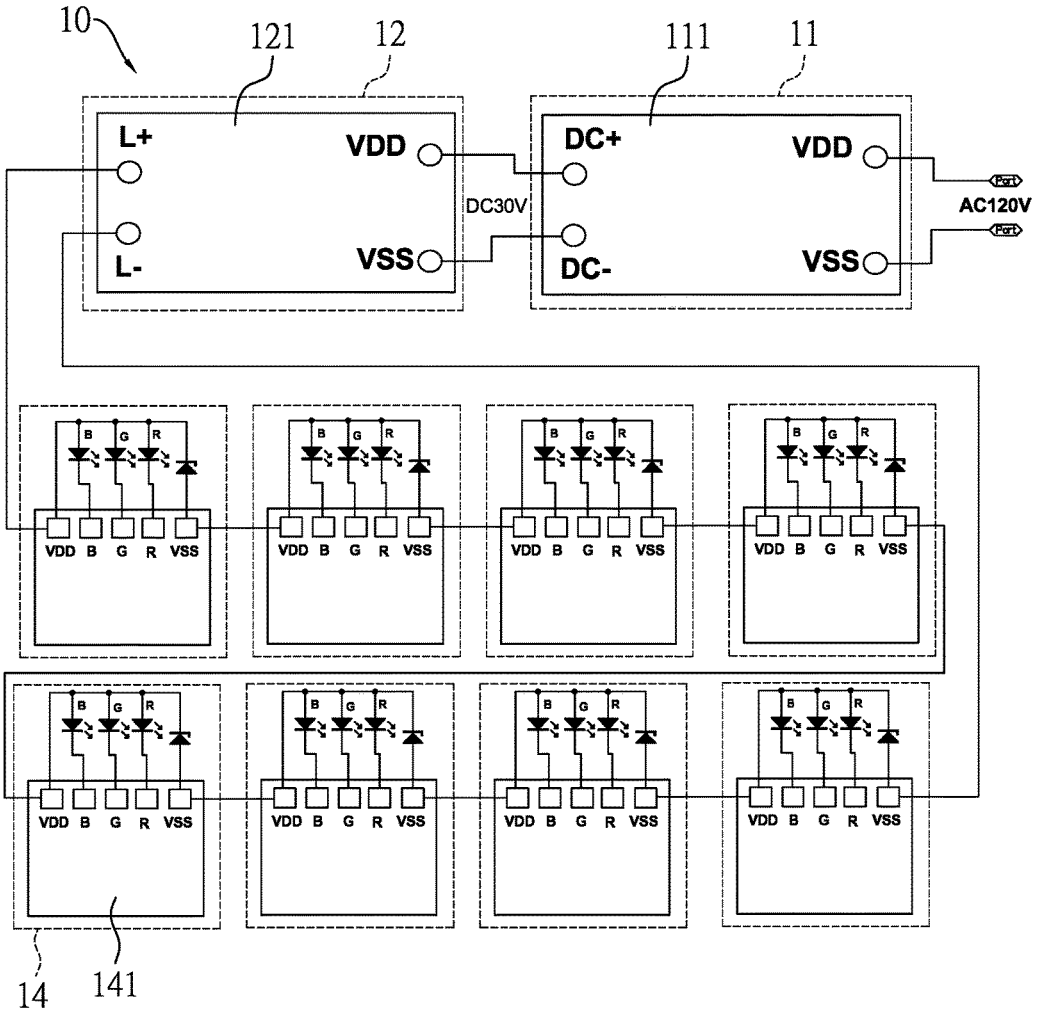
FIG. 2 is a block diagram of the multi-color light apparatus in the present invention.
Figure 3:
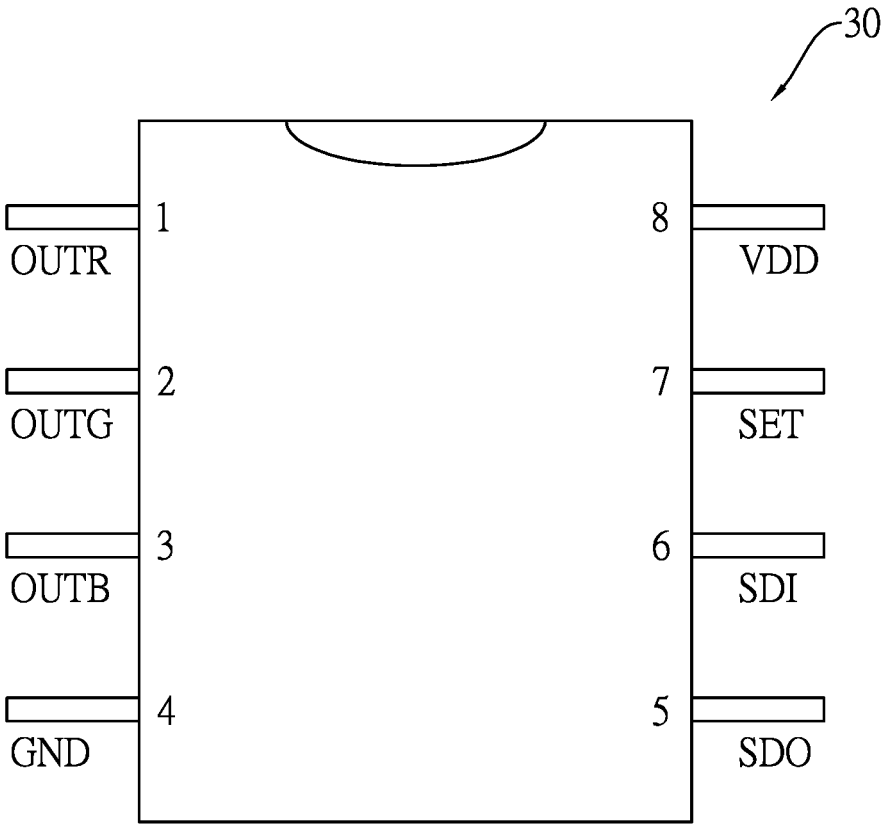
FIG. 3 PRIOR ART
FIG. 3 is a circuit diagram of a conventional driving control IC.

With reference to FIG. 2, the power adapter 11 includes a converter 111 and the power switch 12 includes a controller 121. Alternatively, in a different embodiment, the converter 111 may be included within the power switch 12 and it is not limited herein. The converter 111 is electrically connected to the controller 121. The controller 121 is electrically connected to the light bulbs 14.

The converter 111 is an Alternating Current (AC)/Direct Current (DC) converter and configured to convert AC power to DC power. The controller 121 is preferred to be a DC Wire Transmit Data (DCTD) IC. The controller 121 will output time division multiplexed signals and the DC power converted by the power switch 12 via a power wire to the light bulbs 14. The time division multiplexed signals are coding signals and capable of being transmitted via power cable. For example, the coding signals transmitted via the power cable are Pulse-code Modulation (PCM) signals. The data signals transmitted via the power cable are well known for the person with ordinary skill in the art, and the details thereof are omitted herein. The time division multiplexed signals in the present invention represent different illumination functions respectively. The time division multiplexed signals and power signals of the power adapter 11 will be transmitted at the same time. Therefore, the multi-color light apparatus 10 in the present invention requires only two wires (a power wire for positive electrode and a power wire for negative electrode) to transfer data and power.

Moreover, the light bulbs 14 are preferred to be light emitting diode (LED) light bulks bulbs and each of the light bulbs 14 includes a decoding circuit 141. The decoding circuit 141 is configured to decode the time division multiplexed signals. When the light bulbs 14 receive the time division multiplexed signals, the decoding circuit 141 will drive one of the light bulbs 14 in accordance with the time division multiplexed signals. When the time division multiplexed signals are transmitted to the light bulbs 14 with power signal in one power wire at the same time, the decoding circuits 141 within the light bulbs 14 will decode the time division multiplexed signals and drive the light bulbs 14 in accordance with the time division multiplexed signals.

For example, when the power is turned on by the power switch 12, AC power is converted to DC power by the converter 121. The DC power is transmitted from the power adapter 11 to the power switch 12. The DC power is transmitted to turn on the light bulbs 14 through the controller 121 of the power switch 12. When the power switch 12 is pressed again, one of the time division multiplexed signals is generated and transmitted to the light bulbs 14. The decoding circuits 141 within the light bulbs 14 will drive the light bulbs 14 to flash or illuminate lights of different colors in accordance with the time division multiplexed signals.

Those components within the multi-color light apparatus 10 in the present invention are serially connected to each other and only two power wires are needed. The connection in the multi-color light apparatus 10 is simple and the amount of the power wires is minimized. Therefore, the cost of the multi-color light apparatus is reduced and the manufacture labor may also be saved.

While the present invention has been described in terms of what are presently considered to be the most practical and preferred embodiments, it is to be understood that the present invention need not be restricted to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. A multi-color light apparatus, comprising:

a power adapter having a converter to convert AC power to DC power;

a power switch electrically connected to the power adapter and including a controller to provide a plurality of time division multiplexed signals and the DC power converted by the converter at the same time via a power cable, wherein the plurality of time division multiplexed signals are pulse code modulation (PCM) signals capable of being transmitted via the power cable; and a plurality of light bulbs connected to the controller in series via the power cable, the plurality of light bulbs receiving the plurality of time division multiplexed signals, wherein each of the plurality of light bulbs includes a decoding circuit to decode the plurality of time division multiplexed signals to drive one of the plurality of light bulbs, and wherein the plurality of light bulbs perform different illumination effects in accordance with the plurality of time division multiplexed signals;

wherein the power cable has a first power wire for a positive electrode and a second power wire for a negative electrode, and wherein the power adapter, the power switch, and the plurality of light bulbs are serially connected through the first and second power wires.

2. The multi-color light apparatus as claimed in claim 1, wherein the plurality of light bulbs are LED light bulbs.

3. The multi-color light apparatus as claimed in claim 1, wherein the controller is a DC wire transmit data (DCTD) integrated circuit.

4. The multi-color light apparatus as claimed in claim 1, further comprising a connector electrically connected between the power switch and the plurality of light bulbs.

* * * * *